US010100480B2

(12) United States Patent
Cargol, Jr.

(10) Patent No.: US 10,100,480 B2
(45) Date of Patent: Oct. 16, 2018

(54) SUBSEA BOOMING SYSTEM AND METHOD FOR DEPLOYING A SUBSEA BOOMING SYSTEM

(71) Applicant: TRENDSETTER ENGINEERING, INC., Houston, TX (US)

(72) Inventor: Patrick M. Cargol, Jr., Houston, TX (US)

(73) Assignee: TRENDSETTER ENGINEERING, INC., Houston, TX (US)

( * ) Notice: Subject to any disclaimer, the term of this patent is extended or adjusted under 35 U.S.C. 154(b) by 0 days.

(21) Appl. No.: 15/600,164

(22) Filed: May 19, 2017

(65) Prior Publication Data

US 2017/0350085 A1 Dec. 7, 2017

Related U.S. Application Data

(60) Provisional application No. 62/344,198, filed on Jun. 1, 2016.

(51) Int. Cl.

| | |
|---|---|
| ***E02B 15/06*** | (2006.01) |
| ***E02B 15/08*** | (2006.01) |
| ***E02B 15/10*** | (2006.01) |
| ***B63B 35/32*** | (2006.01) |

(52) U.S. Cl.

CPC ..... *E02B 15/0814* (2013.01); *B63B 35/32* (2013.01); *E02B 15/06* (2013.01); *E02B 15/10* (2013.01)

(58) Field of Classification Search

CPC ..... E02B 15/0814; E02B 15/06
USPC ..... 405/64, 68
See application file for complete search history.

(56) References Cited

U.S. PATENT DOCUMENTS

| | | | | |
|---|---|---|---|---|
| 3,779,020 | A * | 12/1973 | Muramatsu | E02B 15/08 405/64 |
| 3,839,870 | A * | 10/1974 | Ryan | E02B 15/08 405/64 |
| 3,859,796 | A * | 1/1975 | Benson | E02B 15/04 405/64 |
| 3,922,861 | A * | 12/1975 | Grihangne | E02B 15/08 114/54 |
| 4,146,344 | A * | 3/1979 | Steen | E02B 15/08 405/26 |
| 4,252,461 | A * | 2/1981 | Colamussi | E02B 7/005 405/115 |
| 4,573,426 | A * | 3/1986 | Larsson | E02B 15/08 114/267 |
| 5,087,152 | A * | 2/1992 | Whidden | E02B 15/08 114/242 |
| 5,197,821 | A | 3/1993 | Cain et al. | |
| 5,328,296 | A | 7/1994 | Lahar et al. | |

(Continued)

*Primary Examiner* — Frederick L Lagman
(74) *Attorney, Agent, or Firm* — Egbert Law Offices, PLLC

(57) ABSTRACT

A subsea blooming system and method of deploying a subsea blooming system includes a first buoyant module, a first line extending downwardly from the first buoyant module, a first ballast module affixed adjacent an end of the first line, at least one boom translatably connected to the first line, and a variable buoyant module cooperative with the boom. The first buoyant module is positively and non-variably buoyant. The first ballast module is negatively and non-variably buoyant. The boom includes a plurality of booms that are connected in end-to-end relationship in a desired array.

9 Claims, 8 Drawing Sheets

(56) References Cited

U.S. PATENT DOCUMENTS

| | | | | |
|---|---|---|---|---|
| 5,372,455 | A | 12/1994 | Tarca et al. | |
| 5,385,427 | A * | 1/1995 | Kateley | E02B 15/08 405/60 |
| 5,407,575 | A | 4/1995 | Vinsonhaler | |
| 5,470,467 | A | 11/1995 | Soule | |
| 5,533,832 | A | 7/1996 | Dugger | |
| 6,739,801 | B2 | 5/2004 | Dreyer | |
| 6,854,927 | B2 | 2/2005 | Miyazaki | |
| 8,303,212 | B2 * | 11/2012 | Lara | B63B 22/04 405/63 |
| 8,398,334 | B1 | 3/2013 | Doyle | |
| 2004/0120770 | A1 * | 6/2004 | Miyazaki | E02B 15/08 405/63 |
| 2005/0141965 | A1 * | 6/2005 | Byrd | E02B 15/08 405/63 |
| 2012/0087731 | A1 | 4/2012 | Packham | |
| 2013/0129421 | A1 * | 5/2013 | Belzile | E02B 15/0807 405/63 |
| 2014/0197108 | A1 * | 7/2014 | Stratton | E02B 15/06 210/696 |

* cited by examiner

SUBSEA BOOMING SYSTEM AND METHOD FOR DEPLOYING A SUBSEA BOOMING SYSTEM

CROSS-REFERENCE TO RELATED APPLICATIONS

The present utility patent application claims priority from U.S. Provisional Patent Application Ser. No. 62/344,198, filed on Jun. 1, 2016, and entitled "Subsea Booming System".

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to the control and removal of oils in hydrocarbons spells. More particularly, the present invention relates to subsea systems for containing and removing pollutants from the subsea environment. More particularly, the present invention relates to systems for deploying booms so that the boom resides on the mudline.

2. Description of Related Art Including Information Disclosed Under 37 CFR 1.97 and 37 CFR 1.98.

Accidental oil spills frequently occur in navigable bodies of water. Such oil spills often kill a substantial quantity of both land and marine life as the water is polluted and beaches are covered with the resulting oil slick. The resulting environmental damage tends to be devastating in scope and long-lasting in duration.

Oil spills typically occur as a result of either a rupture on an underwater pipeline or on an offshore oil rig or as a consequence of a catastrophic occurrence upon an oil transporting vessel. Ocean currents and winds may carry the oil spill for great distances, occasionally exceeding 1000 miles, where it is ultimately washed up on a beach.

Water vessels, such as tankers and barges, provide cost-effective means for transporting industrial quantities of bulk chemicals, such as oil, for great distances. Such vessels commonly transport quantities of oil in the order of millions of gallons. Thus, the potential devastation caused by the inadvertent release of such chemicals from the transport vessel is well recognized. Money damages can easily run into billions of dollars. Injury to wildlife and the environment is potentially irreparable.

Such oil spills spread quickly, moved by the wind and ocean currents. Therefore, they must be contained rapidly, before reaching a size that makes containment impossible. Contemporary practice is to contain the oil slick by surrounding it with a floating barrier, commonly known as an oil boom. After the oil boom has contained the oil slick, various means may be utilized to disperse, destroy, or collect the oil. Various chemicals may be utilized to cause the oil to break up, dissolve, and/or sink to the bottom of the water. The use of such chemicals for making the oil miscible in water thus appears to alleviate the oil spill. However, the oil is merely spread throughout the water such that it may eventually cause even greater environmental damage. The preferable course of action is to collect the oil so as to remove it from the sea.

Unfortunately, the use of sinking agents as a oil spill control method merely causes the pollutants to sink to the mudline. Ultimately, because of currents in the body of water, the sunken pollutants can migrate to undesired locations. Extensive environmental damage can be caused by the sunken pollutants. Additionally, certain types of pollutants will have a density that is greater than the water. As such, they will inherently sink toward the mudline. As such, a need has developed so as to effectively control and remove the sunken oil pollutants from the mudline.

Contemporary oil booms have a plurality of partitions or fence-like sections which float upon the surface of the water and extend a short distance below the surface in an attempt to contain the oil spill within a defined area. Unfortunately, contemporary oil spill containment and recovery systems are slow to deploy, comparatively ineffective at containing the oil spill, relatively labor-intensive in their deployment and operation, and relatively inefficient and expensive to operate. Thus, contemporary oil containment and recovery systems suffer from substantial deficiencies which detract from their overall effectiveness and desirability. As such, it is desirable to provide a means for containing, removing and storing sunken oil spills which can be rapidly transported to the spill site, quickly set up, and efficiently operated.

In the past, various patents have issued with respect to oil spill containment systems. For example, U.S. Pat. No. 5,197,821, issued on Mar. 30, 1993 to Cain et al., describes an emergency, lightweight marine containment system that is comprised of a containment crate in which it is flatly accordion-folded in an uninflated boom curtain. The boom curtain is comprised of a self-inflating flotation chamber on one longitudinal edge with an integral depending curtain terminating in a self-inflating ballast chamber on the opposing longitudinal edge. The flotation chamber is inflated by gas in the ballast chamber or is inflated by the water or seawater into which the boom curtain is disposed.

U.S. Pat. No. 5,328,296, issued on Jul. 12, 1994 to Lahar et al., provides an oil spill containment system that has a deployable flotation collar and an apron apparatus that automatically surrounds the periphery of the vessel to be contained. The collar is stored in a gunnel above the deck and is lowered into the water by a gear or spring-torsion driven pivot arms that lift the collar from the deck area and up and over the gunnel. The collar is inflated after lowering over the gunnel, encircling the entire vessel and giving vertical support to an attached apron. The top edge of the apron is maintained level with the surface of the oil spill by means of the attached inflatable collar.

U.S. Pat. No. 5,372,455, issued on Dec. 13, 1994 to Tarca et al., discloses a boom assembly that is carried on board a vessel for automatic deployment around the vessel to contain an oil spill. The boom assembly comprises an inflatable tube supporting a skirt that has a bottom edge which is weighted by a weight. The boom assembly is stored in an uninflated folded form in an elongate member which serves as the deck handrail of the vessel. The tubes are connected to a source of pressurized air via airlines. The capsule has hinged sections which are normally sealed. Upon inflation of the tubes, the seal is broken by expansion of the tubes and the hinged sections open to automatically deploy the boom assembly around the vessel.

U.S. Pat. No. 5,470,467, issued on Nov. 28, 1995 the W. T. Soule, provides an oil spill containment and recovery system for confining and collecting oil spills. The oil spill is surrounded and contained within a floating barrier and the oil is pumped from within the enclosure defined by the floating barrier into floating reservoirs proximate the barrier. The floating barrier utilizes an elongate inflatable buoyant member and an elongate suction conduit depending downwardly from the buoyant member and having a plurality of apertures formed therein through which oil flows into the suction member. The inflatable member is inflated with care to obtain the desired buoyancy. The weight depends downwardly from the suction conduit to maintain the buoyant member and suction conduit in a desired orientation to facilitate containment and collection of the oil spill. The buoyant member is collapsible into a substantially flat configuration such that the floating barrier and conduit can be wrapped around a reel in a compact manner which facilitates storage and transportation thereof. A pump in fluid communication with the suction conduit effects oil flow from the suction conduit to a centrifuge which separates water from the collected oil. The oil is then pumped to a floating reservoir proximate the floating barrier.

U.S. Pat. No. 5,407,575, issued on Apr. 18, 1995 to C. W. Vinsonhaler, discloses an oil spill cleanup and recovery system that comprises a two-part sorbent pad having a flat, chemically-treated polyethylene foam inner core completely surrounded by a flexible, durable, chemically-treated polypropylene fabric cover. The sorbent pad floats on top of the petroleum-covered water to rapidly soak up the petroleum or oil and hold it within the inner core until it can be removed by squeezing the sorbent pad between rollers, thereby depositing the oil into a container for storage. The non-petroleum-laden sorbent pad is then returned to the surface of the petroleum-covered water to pick up more petroleum. The sorbent pad is chemically treated to increase the pad's ability to attract and hold oil by both adsorption and absorption and to further increase its ability to repel water.

U.S. Pat. No. 5,533,832, issued on Jul. 9, 1996 the H. W. Dugger, shows an oil spill containment and recovery system which comprises the circumventing of an offshore spill with multiple containment float/recovery trough sections for collecting the spilled petroleum from the surface of the water. The water and petroleum mixture is transferred from the collection trough by a heavy-duty pump to a separation tank and, upon separation from the water, the recovered petroleum is transferred to a storage tank.

U.S. Pat. No. 6,739,801, issued on May 25, 2004 to H. P. Dreyer, shows a boom curtain with zipper connections and a method of assembling the boom curtain. The modular boom curtain sections include zipper elements for connection of adjacent modular boom curtain sections.

U.S. Pat. No. 6,854,927, issued on Feb. 15, 2005 to K. Miyazaki, discloses a containment boom capable of functioning as a barrier for containment of oil spills. The containment boom comprises a plurality of float units and a coupling portion by which adjacent float units are coupled to one another. Each of the float units comprises a housing having an oil-shielding surface perpendicular to a sea level, a float portion having a buoyant force, and a plummet portion positioned under the float portion. The float portion and the plummet portion are adjusted so as to locate a water line to an approximately middle position of the vertical length of the oil shielding surface. The coupling portion is a flexible coupling portion for varying a relative position between the adjacent float units.

U.S. Pat. No. 8,398,334, issued on Mar. 19, 2013 to R. Doyle, describes a self-positioning subsea oil spill containment system for retaining spills in a body of water. The containment system remains in a submerged position for continuous monitoring and is deployed at the surface when activated for containment purposes. A vertically-retractable barrier is configured to encircle an infrastructure. A ballast system is coupled to the barrier. The ballast system is adapted to be submerged to a target depth upon receiving submerging signals and the surface upon receiving surfacing signals. A deployment control system is in operative communication with the ballast system. The deployment control system is configured to send submerging signals to employ the ballast system to submerg to a standby depth for extended periods of nominal operating conditions and send surfacing signals to employ the ballast system to surface upon spill conditions. A self-propulsion system is provided for containment system position management and an access gate for emergency vessel passage.

U.S. Patent Application Publication No. 2012/0087731, published on Apr. 12, 2012 to A. R. Packham, shows an oil retention boom for retaining oil on the surface of the body of water. The boom includes a sensor for detecting the oil and electronic circuitry coupled with the sensor.

It is an object of the present invention to provide a subsea booming system that provides underwater mudline booming capabilities that are not currently available.

It is another object of the present invention to provide a subsea booming system that is economical and efficient for underwater heavy oil and chemical containment.

It is another object of the present invention to provide a subsea booming system that utilizes conventional surface booming technologies and deployment equipment.

It is another object of the present invention to provide a subsea booming system that avoids entrapment of marine life.

It is another object of the present invention to provide a subsea booming system that has the ability to monitor effectiveness once deployed.

It is still another object of the present invention to provide a subsea booming system that can be rapidly deployed.

It is another object of the present invention to provide a subsea booming system that can be used in depths of water of up to 500 feet.

It is another object of the present invention to provide a subsea booming system that can be used in weather conditions up to four knots.

It is still another object of the present invention to provide a subsea booming system that is configured to capture, contain, diver, deflect or exclude subsea pollutants.

These and other objects and advantages of the present invention will become apparent from a reading of the attached specification and appended claims.

BRIEF SUMMARY OF THE INVENTION

The present invention is a subsea booming system that includes a first buoyant module, a first line extending downwardly from the first buoyant module, a first ballast module affixed to an end of the line, at least one boom translatably connected to the line, and a variable buoyant module cooperative with the boom.

The first fixed buoyant module is suitable for floating on the surface of the body of water. The first buoyant module is positively buoyant and non-variably buoyant. The first line can comprise a skirt which is impermeable so as to prevent pollutant migration. The skirt can be of a single or double-walled material. The first ballast module is affixed generally to the end of the line. The first ballast module is negatively and non-variably buoyant. The first ballast module is adapted to constantly contact the mudline.

The at least one boom is a longitudinal member having a desired thickness. The boom can include a plurality of booms that are connected in end-to-end relationship. The plurality of booms can be arranged in a desired array. This desired array can be in the nature of an enclosure, a cup, or a deflector.

The variable buoyancy module is adjustable from being positively buoyant to being negatively buoyant. In the positively buoyant configuration, the variable buoyant module allows the boom to float on the surface of the body of water. The negatively buoyant configuration allows the buoyant module to sink to the mudline.

In the present invention, there is a second buoyant module in spaced relationship to the first buoyant module, a second line extending downwardly from the second buoyant module, and a second ballast to module affixed to an end of the second line. The boom has one end translatably mounted on the second line. Also in the present invention, a ship is provided which has a line-deploying reel thereon. The first line and the second line can be wrapped around the line-deploying reel. Additionally, the buoyant modules, the ballast modules, the booms, and the variable buoyant modules can be stored on the deck of the ship prior to being deployed.

The present invention is also a method of deploying a subsea booming system. This method includes the steps of: (1) lowering a weight to the mudline such that the weight resides on the mudline; (2) affixing a buoy to a line from the ballast module such that the buoy floats on the water; (3) inflating a variable buoyant module associated with a boom; (4) assembling additional booms in generally end-to-end relationship at the surface of the body of water so as to form an array; (5) deflating the variable buoyant module so as to lower the boom toward the mudline; and (6) vacuuming the pollutant from within the boom array.

The weight is a ballast module that is negatively and non-variably buoyant. The ballast module is in constant contact with the mudline. The ballast module has the line extending therefrom upwardly toward the ship. The buoy is a buoyant module that is positively buoyant and non-variably buoyant. The boom has an end that is cooperative with the line.

The step of assembling the additional booms includes connecting the variable buoyant module to the boom. The step of assembly includes forming a desired configuration or array. This array can be in the nature of an enclosure, a cup, or a deflector.

In the method of the present invention, another weight can be lowered on another line toward the mudline such that the weight resides on the mudline. This another line is in spaced relationship to the first line. The end of the array of booms is translatably mounted on the second line. In particular, the outermost boom of the array is connected to the another line. The method of the present invention further includes inflating the variable buoyant module so as to rise to the surface of the bottom of the body of water. The weight at the mudline can then be lifted by the reel on the ship and then stowed, along with the booms, on the ship.

This foregoing Section is intended to describe, with particularity, the preferred embodiments of the present invention. It is understood that modifications to these preferred embodiments can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
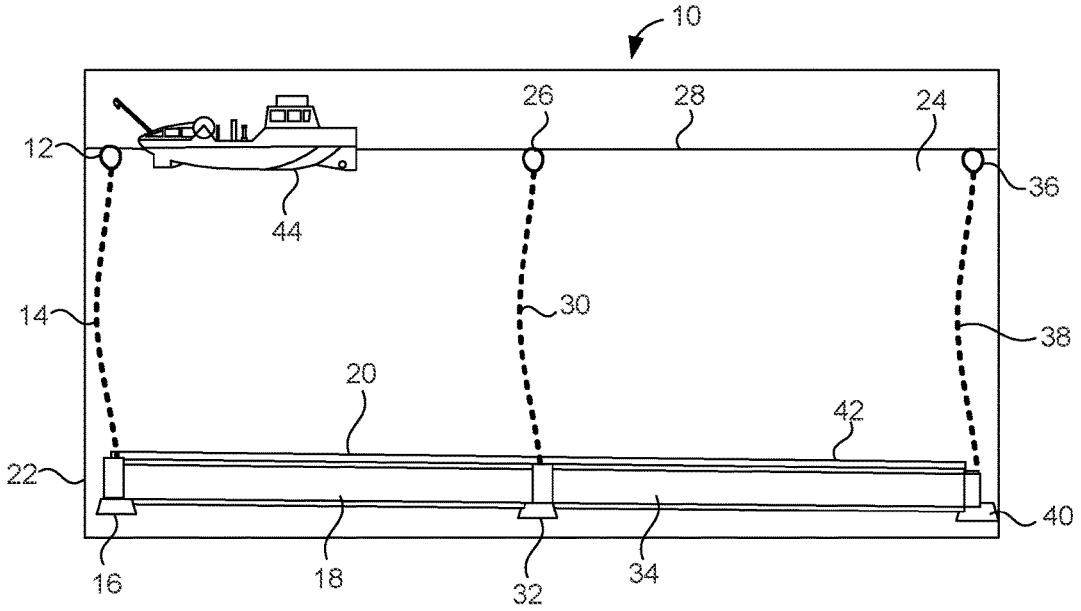
FIG. 1 is a side elevational view showing the subsea booming system in accordance with the present invention.

Referring to FIG. 1, there is shown the subsea booming system 10 in accordance with the present invention. The subsea booming system includes a first buoyant module 12, a first line 14 extending downwardly from the first fixed buoyant module 12, a first bottom ballast module 16 affixed to an end of the line 14 opposite the first fixed buoyant module 12, a first boom 18 translatably mounted on the first line 14 and a variable buoyant module 20 cooperative with the first boom 18.

The first fixed buoyant module 12 is positioned adjacent to one end of the boom 18. The first line 14 extends downwardly from the first fixed buoyant module 12 downwardly toward the mudline 22 of the body of water 24. As can be seen, the first bottom ballast module 16 is positioned on or in the mudline 22. The first boom 18 will extend along with the mudline 22 so as to provide a containment surface thereon.

A second fixed buoyant module 26 is positioned on the surface 28 of the body of water 24. The second fixed buoyant module 26 is in spaced relationship to the first fixed buoyant module 12. A second line 30 extends downwardly from the second fixed buoyant module 26. A second bottom ballast module 32 is at an end of the line 30 and positioned at the mudline 22. A second boom 34 is positioned on the mudline 22 and is cooperative with the second line 30 so as to lower along the line 30. The second boom 34 is connected in end-to-end relationship with the first boom 18 so as to further provide a containment array. A third fixed buoyant module 36 is positioned at the surface 28 of the body of water 24 in spaced relationship to the second fixed buoyant module 26 and the first fixed buoyant module 12. A line 38 extends downwardly from the third fixed buoyant module 36. A third bottom ballast module 40 is affixed to the end of the third line 38 opposite the third fixed buoyant module 38 and resides on the mudline 22. The second boom 38 is cooperative with the third line 38 so as to be translatable with respect to the third line 38 and the second line 30 so as to be lowered to the mudline 22. A second variable buoyant module 42 is cooperative with the second boom 38 so as to achieve the requisite buoyancy of the boom 38 for the purposes of raising and lowering the boom 38.

A ship 44 is located on the surface 28 of the body of water 24. The ship 44 can include the requisite reeling equipment and a storage area so that each of the components associated with subsea booming system 10 of the present invention can be either delivered from or retrieved onto the deck of the ship 44.

Figure 2:
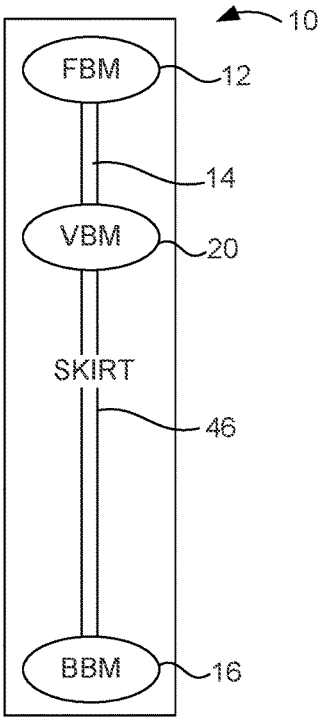
FIG. 2 is a diagrammatic illustration of the subsea booming system of the present invention.

FIG. 2 is a diagrammatic illustration of the subsea booming system 10. It can be seen that the first fixed buoyancy module 12 is located at the top of the subsea booming system 10. The first fixed buoyant module 12 is positively buoyant and non-variably buoyant. The fixed buoyancy ensures that the first boom 12 remains proud from the mudline once on the bottom. A first fixed buoyancy module 12 has a buoyancy that is calculated so that the bottom ballast module 16 is prevented from bottom fluctuation or flutter and so as to control the descent rate of the boom 18 in the event of a failure of the variable buoyant module 20. The material of the first fixed buoyant module 12 should be compressible so as to allow for minimum storage dimensions and for ease of deployment and recovery from the reel unit. The variable buoyant module 20 is variably buoyant so as to allow for adjustment from positive to neutral buoyancy. During deployment and recovery, the variable buoyant module 12 is used to control the descent and ascent of the boom 18 to or from the mudline 22 through the water column. The variable buoyant module 20 is designed to incorporate the ability to adjust buoyancy from the surface (i.e. with a whip connected to the module and attached to the guide wire) and provide the ability to float the variable buoyant module 20 on the surface 28 of the body of water 24 so as to facilitate deployment in recovery with a conventional surface asset. A skirt 46 is shown on the line 14. The skirt 46 is impermeable. As such, it prevents the migration of hydrocarbons and contaminated sediment through the boom 18. It can be made of a single or double walled material that does not retain water or hydrocarbons.

The bottom ballast module 16 is negatively and non-variably buoyant. The bottom ballast module 16 can be a clump weight which is a fixed ballast to ensure that the boom 18 remains in place and in constant contact with the mudline. The bottom ballast module 16 has a ballast that is calculated so that it is sufficiently more than the fixed buoyant module 12 regard to prevent bottom fluctuation or flutter. The ballast materials should be selected to allow for minimum storage dimensions and ease of deployment and recovery.

The subsea booming system 10 is designed to provide underwater/mudline booming capabilities not currently available in the market. The system 10 is designed to provide an economical and efficient solution for underwater heavy oil and chemical containment using conventional surface booming techniques and deployment equipment. The open top design prevents entrapment of marine life. Cameras or laser density measuring devices can be attached to the boom to monitor effectiveness once deployed. The system can be rapidly deployed and used in depths up to 500 feet and is suitable for use in conditions of the four knots. The system 10 is configured for capture, containment, diversion, deflection or exclusion operations.

Figure 3:
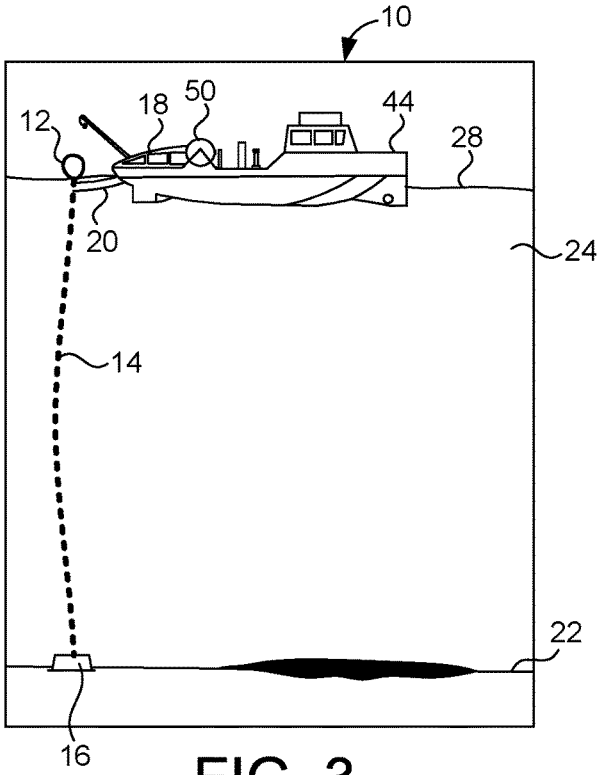
FIG. 3 shows an initial step in the deployment of the subsea booming system of the present invention.
Figure 10:
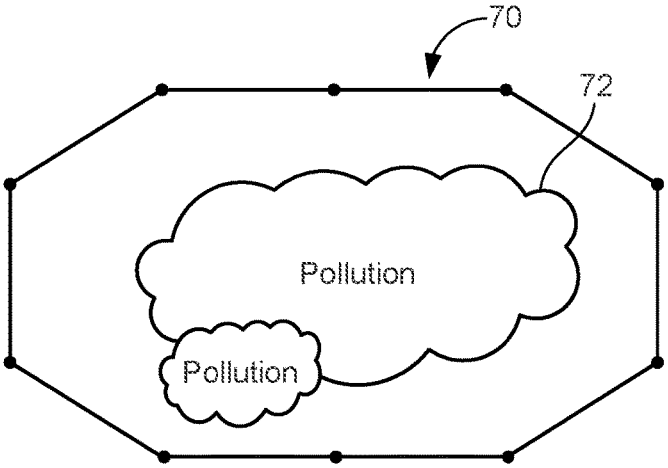
FIG. 10 is a diagrammatic illustration of an enclosure formed by the booms of the subsea booming system of the present invention.

FIG. 3 shows an initial step of the deployment of the subsea booming system 10 of the present invention. In FIG. 3, it can be seen that the ship 44 is traveling on the surface 28 of the body of water 24. In FIG. 10, the bottom ballast module 16 has been affixed to the first line 14 and lowered by a reel 50 located on the ship 44. The first bottom ballast module 16 will reside on the mudline 22 at the bottom of the body of water 24. The first line 18 extends upwardly toward the surface 28. The first fixed buoyant module 12 is then attached to the upper end of the first line 18 so that the first fixed buoyant module 12 will float on the surface 28 of the body of water. The first variable buoyant module 20 is deployed from the ship 44 much like a conventional boom. It is stored, deployed and recovered from the reel unit 50 off the stern of the ship 44. The variable buoyant module 20, along with one end of the boom 18, will be translatably mounted on to the line first line 14. During deployment, the variable buoyant module 20 is inflated to provide positive buoyancy so as to allow for the boom 18 to be floated on the surface 28 of the water 24.

Figure 4:
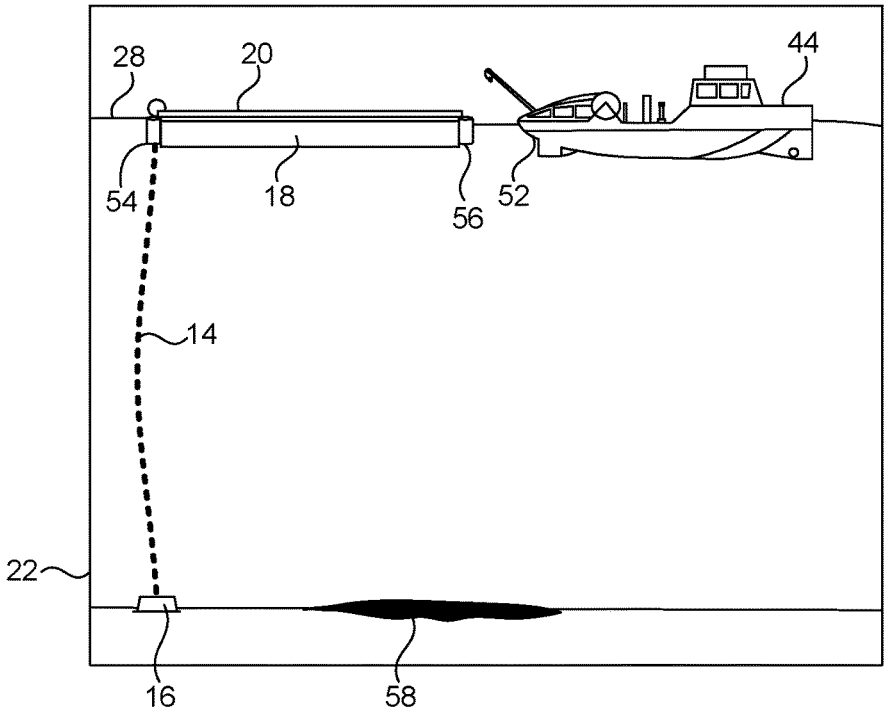
FIG. 4 shows a subsequent step in the deployment of the subsea booming system of the present invention.

FIG. 4 shows that the variable buoyant module 20 and the first boom 18 are delivered off of the stern 52 of the ship 44. The variable buoyant module 18 allows the boom 18 to float on the surface 28 of the body of water 24. In particular, it can be seen that there is a tubular member 54 formed at the end of the first boom 18 through which the first line 14 will extend. The opposite end 56 of the first boom 18 is positioned so as to allow for the attachment of another variable buoyant module and another boom thereto. The first boom 18 can be a one hundred foot section of boom that can be either connected directly to an adjacent boom for attached to the clump weight assemblies at the surface. FIG. 4 further shows that the bottom ballast module 16 will be located adjacent to a pollutant 58 at the mudline 22.

Figure 5:
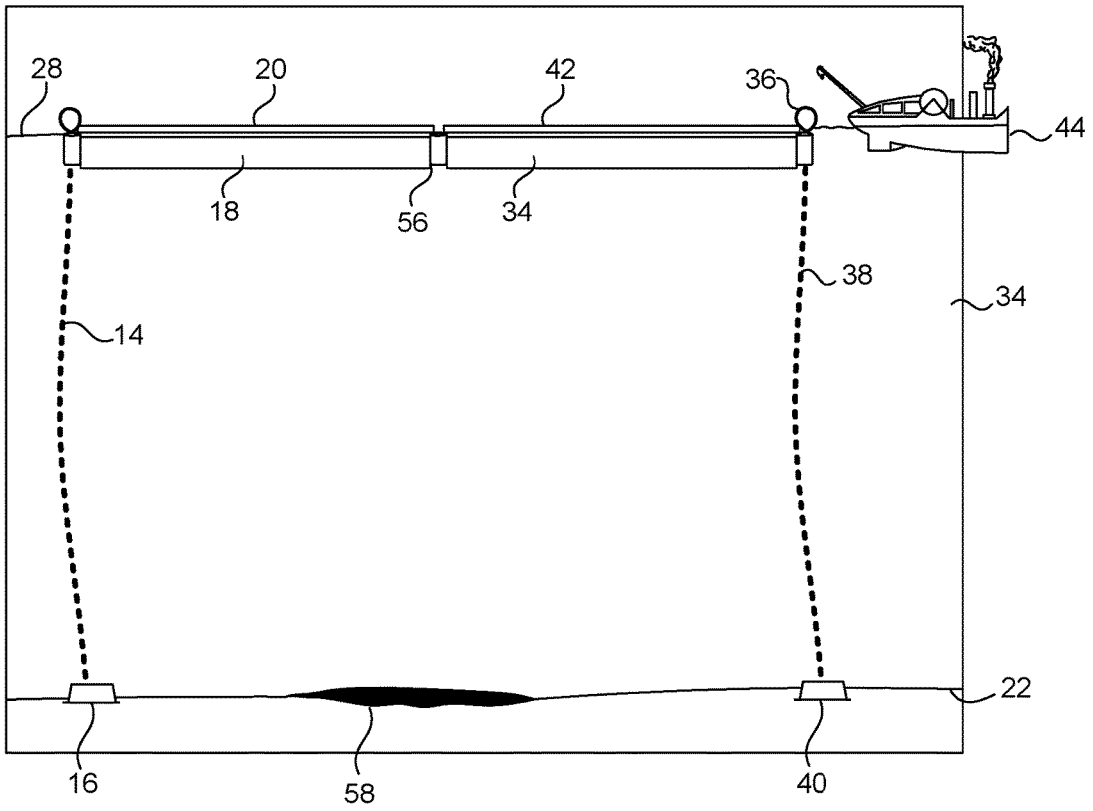
FIG. 5 shows a further subsequent step in the deployment of the subsea booming system of the present invention.

FIG. 5 shows that the second boom 34 is affixed to the end 56 of the first boom 18. The variable buoyant module 42 is suitably inflated so that the second boom 34 can also float on the surface 28 of the body of water 24. The second line 38 is connected to the bottom ballast module 40. The bottom ballast module 40 is also located in or on the mudline 22 in spaced relationship to the first bottom ballast module 16 and generally adjacent to an opposite side of the pollutant 58. The second line 38 extends in spaced relationship to the first line 14. The second fixed buoyant module 36 is secured to an upper end of the second line 38 and also float on the surface 28 of the body of water 24. As such, FIG. 5 shows that the first boom 18 is connected to the second boom 34 and in which the first buoyant module 20 and the second buoyant module 42 cause the booms 18 and 34 to float on the surface 28 of the body of water 24. The booms 18 and 34 are now ready to be lowered to the mudline 22. The ship 44 is illustrated as moved out of position away from the booms 18 and 34.

Figure 6:
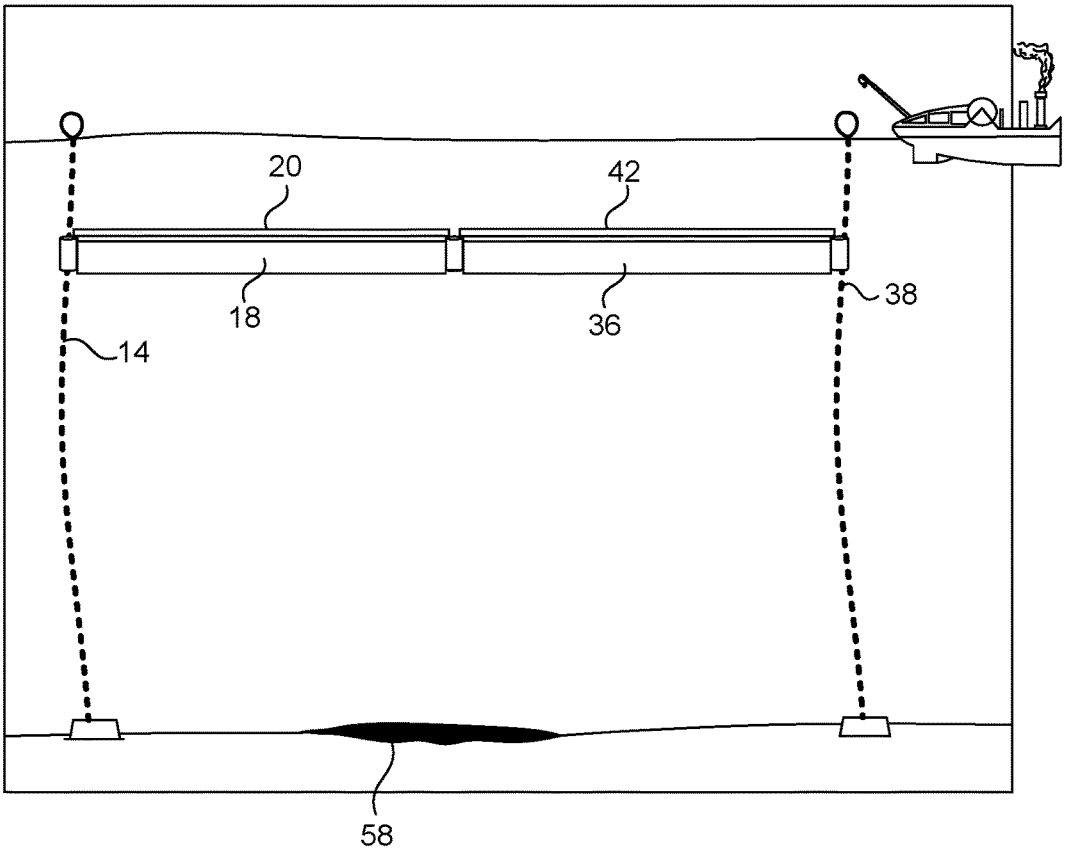
FIG. 6 shows still a further step in the deployment of the subsea booming system of the present invention.

FIG. 6 shows the initial deployment of the booms 18 and 34 downwardly toward the mudline 22. The variable buoyant modules 20 and 42 are adjusted so as to slowly convert the entire boom assembly to negative buoyancy and to allow the booms 18 and 36 to land gently onto the mudline 22 in a desired configuration or array. The ends of the booms 18 and 36 will slide downwardly along the respective lines 14 and 38 until the booms 18 and 36 reside over or around the pollutant 58 at the mudline 22.

Figure 7:
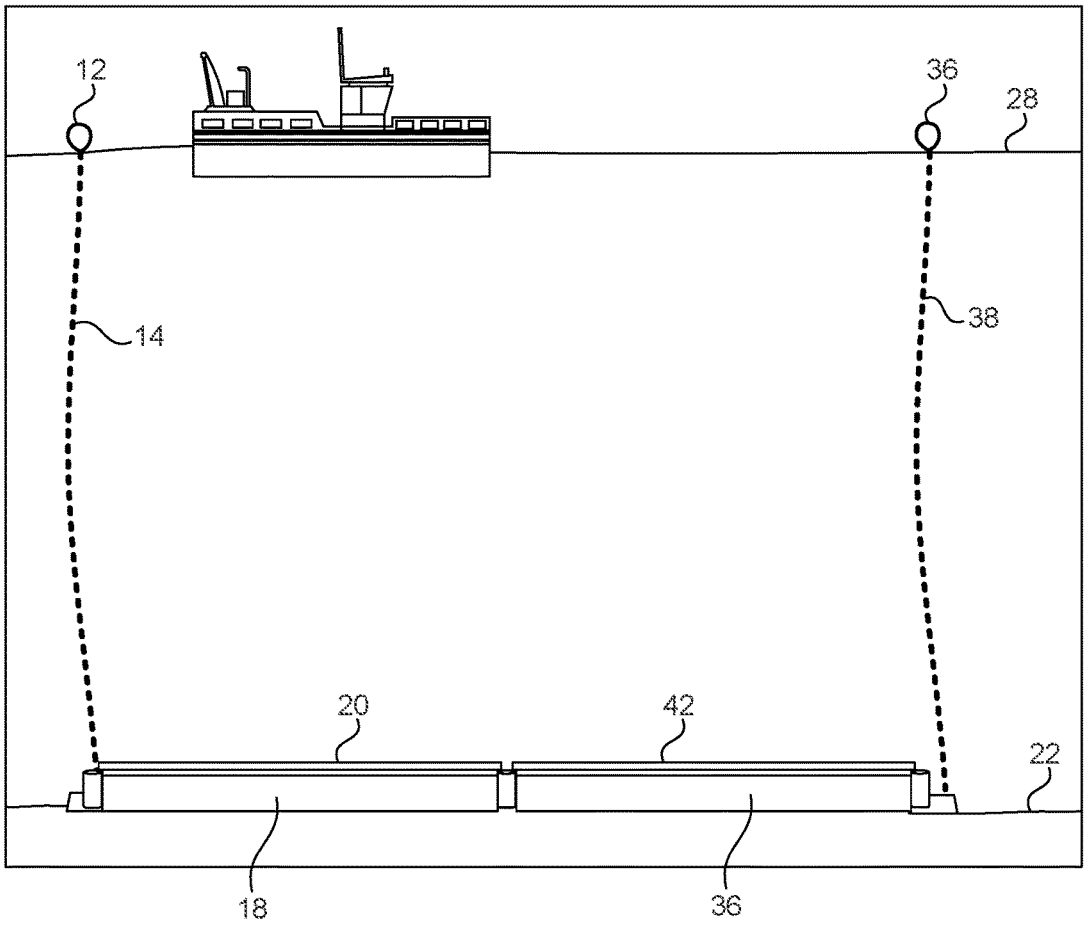
FIG. 7 shows a further step in the deployment of the subsea booming system of the present invention.

FIG. 7 shows that the booms 18 and 36 are now positioned at the mudline 22. The variable buoyant modules 20 and 42 are suitably deflated so as to allow each of the booms 18 and 36 to drift slowly downwardly toward the mudline 22 and reside thereon. The lines 14 and 38 extend upwardly and are supported respectively at the surface 28 by the fixed buoyancy modules 12 and 36. Once in place, the hydrocarbons, sediment or chemicals are then contained in an area surrounded by the array of booms.

Figure 8:
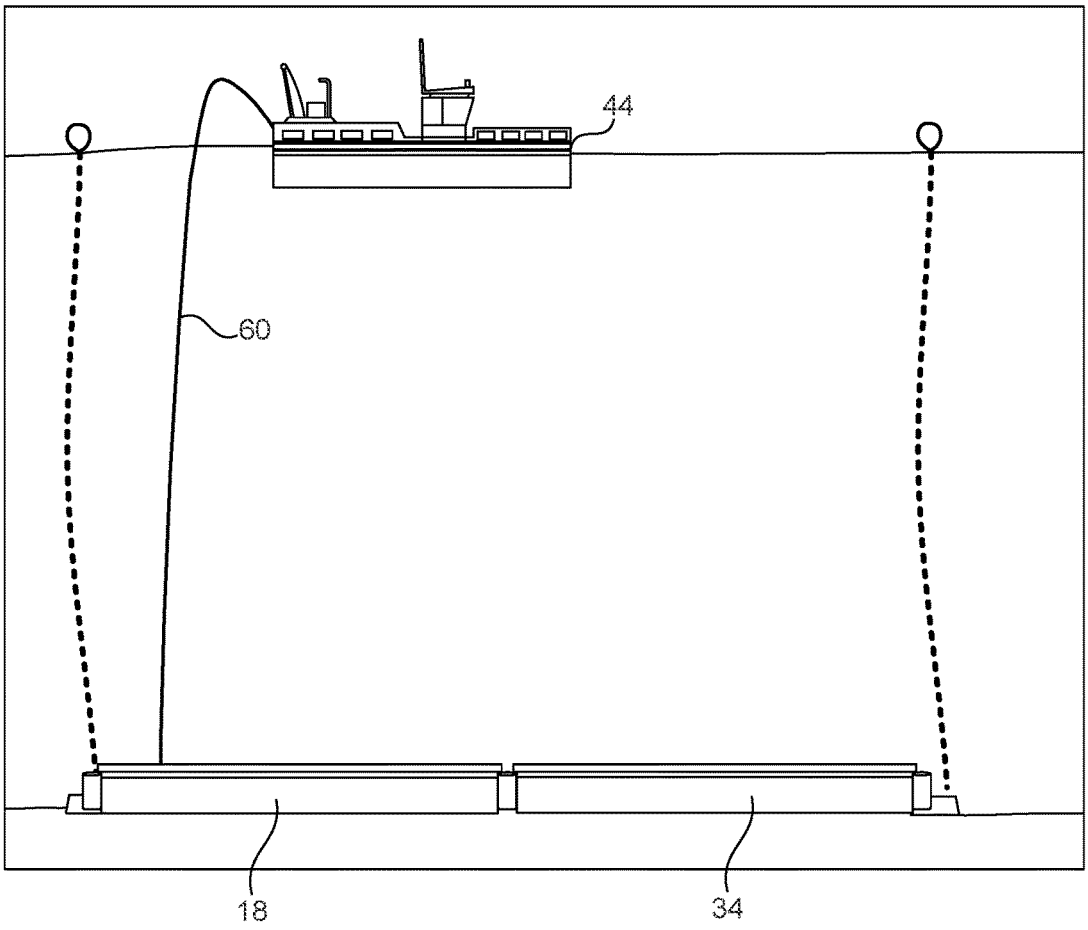
FIG. 8 illustrates the pollutant removal step associated with the deployment of the subsea booming system of the present invention.

FIG. 8 shows that there is a suction line 60 that extends from the ship 44 and downwardly to the area contained within the array of the booms 18 and 34. The suction line 60 allows the hydrocarbons, sediment or chemicals of the pollutant 58 to be recovered to the surface. The suction line 60 can be associated with a vacuum dredge or submersible pump. Alternatively, the booms 18 and 34 can be used so as to deflect the pollutant 58 from a protected area.

Figure 9:
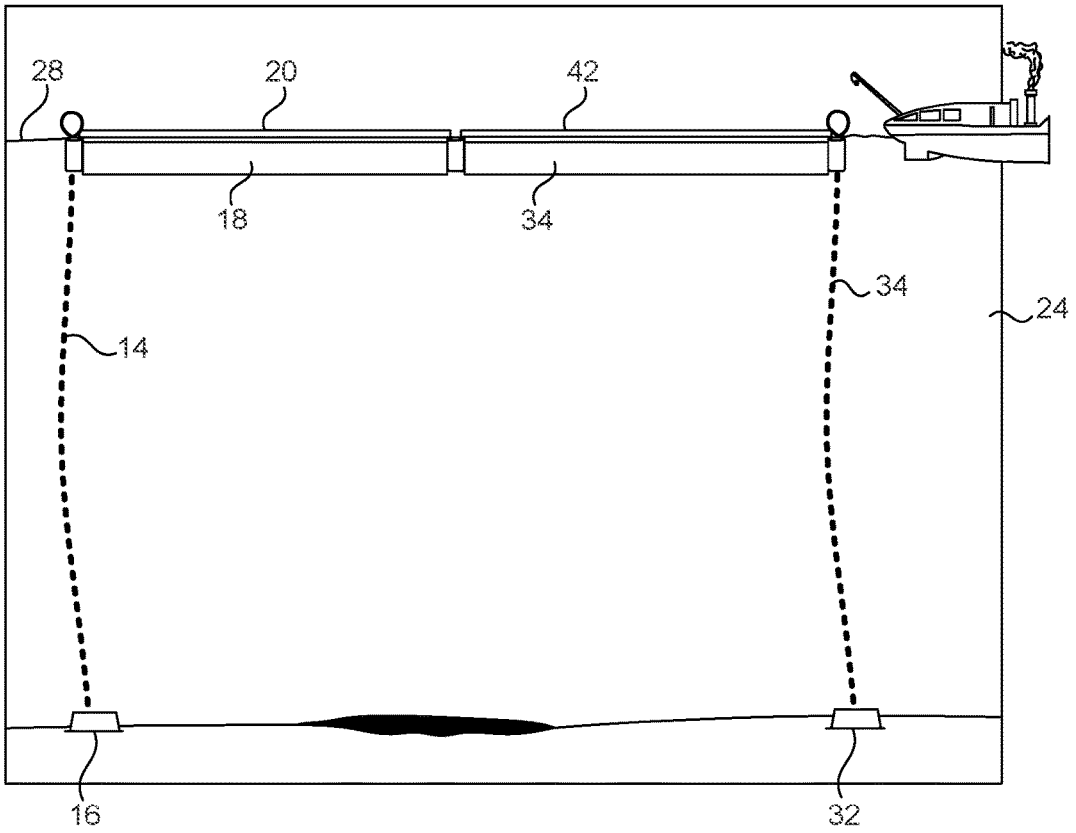
FIG. 9 shows the step of removing the subsea booming system from of the mudline of the present invention.

FIG. 9 shows how the booms 18 and 34 are recovered back to the surface 28 of the body of water 24. In particular, the respective variable buoyant modules 20 and 42 are adjusted so as to return to positive buoyancy. The booms 18 and 34 can then be recovered at the surface 28 in the reverse manner as deployment. Similarly, the bottom ballast modules 16 and 32, along with the respective lines 14 and 38, can further be recovered at the surface 28.

FIG. 10 illustrates one array 70 of the various booms. In FIG. 10, it can be seen that the booms form an enclosure around the pollutant 72. As such, the pollutant 72 will be fully contained within the interior of the enclosure 70 formed by the boom. As such, the suction line 60 can be utilized so as to remove the pollutant 72 from the interior of the enclosure 70.

Figure 11:
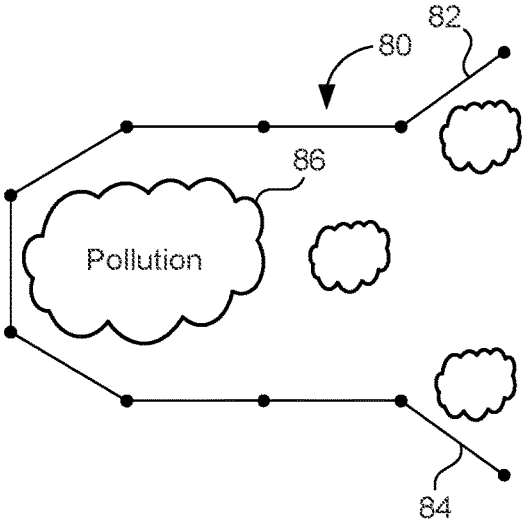
FIG. 11 is a plan view showing a cup-like array of the booms in the subsea booming system of the present invention.

FIG. 11 shows the array of booms 80 in a cup-like configuration. The outer ends 82 and 84 are configured so as to funnel the pollutant 86 inwardly. As such, if the pollutants 86 are migrating along the mudline, the cup-shape configuration of the array 80 can be utilized so as to collect the pollutants. The suction line can then be utilized so as to remove the pollutants 86 from the collecting end of the cup-like configuration of the arrays 80.

Figure 12:
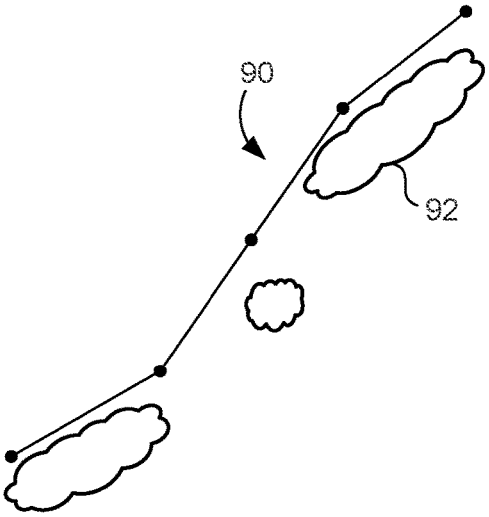
FIG. 12 is a plan view showing a deflector array associated with the subsea booming system of the present invention.

FIG. 12 shows the array 90 of the booms in the form of a deflector. In certain circumstances, it is desirable to deflect the pollutants 92 away from a protected area. As such, the booms of the array 90 can be arranged in a generally linear or partially-linear configuration so that the flow or movement of the pollutants 92 is directed away from a protected area.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A subsea booming system for containing heavy oil or chemicals at a subsea mudline, the subsea booming system comprising:

a first buoyant module that is positively and non-variably buoyant;

a first line extending downwardly from said first buoyant module;

a first ballast module affixed adjacent to an end of said first line, said first ballast module being negatively and non-variable buoyant;

at least one boom translatably slidable connected to said first line; and a variable buoyant module cooperative with said at least one boom so as to allow said at least one boom to move along said first line from a position at a surface of a body of water to a position at the subsea mudline.

2. The subsea booming system of claim 1, said first buoyant module affixed adjacent an end of said first line opposite said first ballast module.

3. The subsea booming system of claim 1, said first ballast module adapted to constantly contact a mudline.

4. The subsea booming system of claim 1, said at least one boom being a longitudinal member.

5. The subsea booming system of claim 4, said at least one boom comprising a plurality of booms that are connected in end-to-end relationship, said plurality of booms being in a desired array.

6. The subsea booming system of claim 5, said desired array selected from the group consisting of an enclosure, a cup and a deflector.

7. The subsea booming system of claim 1, said variable buoyancy module being adjustable between positive buoyancy and negative buoyancy, said at least one boom floating on a surface of the body of water when said variable buoyancy module is positively buoyant, said at least one boom sinking to a mudline when said variable buoyancy module is negatively buoyant.

8. The subsea booming system of claim 1, further comprising:

a second buoyant module in spaced relation to said first buoyant module;

a second line extending downwardly from said second buoyant module;

a second ballast module affixed adjacent an end of said second line, said at least one boom having an end translatably mounted to said second line.

9. The subsea booming system of claim 1, further comprising:

a ship having a line-deploying reel thereon, said line-deploying reel being cooperative with said first line so as to deploy said first line.

* * * * *